US011890666B2

(12) United States Patent
Nylander

(10) Patent No.: US 11,890,666 B2
(45) Date of Patent: Feb. 6, 2024

(54) AUTOMATIC TRIMMING APPARATUS FOR WIRE COILS

(71) Applicant: Yeminy Inc., Sheridan, WY (US)

(72) Inventor: Jens Nylander, Lycksele (SE)

(73) Assignee: Yeminy Inc., Sheridan, WY (US)

( * ) Notice: Subject to any disclaimer, the term of this patent is extended or adjusted under 35 U.S.C. 154(b) by 0 days.

(21) Appl. No.: 18/254,876

(22) PCT Filed: Nov. 30, 2021

(86) PCT No.: PCT/EP2021/083629
§ 371 (c)(1),
(2) Date: May 29, 2023

(87) PCT Pub. No.: WO2022/117584
PCT Pub. Date: Jun. 9, 2022

(65) Prior Publication Data

US 2023/0321714 A1 Oct. 12, 2023

(30) Foreign Application Priority Data

Dec. 4, 2020 (EP) ..... 20211785

(51) Int. Cl.
*B21F 11/00* (2006.01)
*B21C 47/14* (2006.01)
(Continued)

(52) U.S. Cl.
CPC ..... *B21F 11/00* (2013.01)

(58) Field of Classification Search
CPC ..... B21F 11/00; B21F 11/005
See application file for complete search history.

(56) References Cited

U.S. PATENT DOCUMENTS 6,705,355 B1 * 3/2004 Wiesenfeld ..... B23D 17/02 140/140
11,618,069 B2 * 4/2023 Teegavarapu ..... G01N 33/20 83/79

(Continued)

FOREIGN PATENT DOCUMENTS

| | | | |
|---|---|---|---|
| EP | 0992298 | A2 | 4/2000 |
| GB | 2047597 | A | 12/1980 |
| KR | 101568593 | B1 | 11/2015 |

OTHER PUBLICATIONS

International Sear Report and Written Opinion dated Mar. 29, 2022 in International Application PCT/EP2021/083629.

*Primary Examiner* — Matthew Katcoff
*Assistant Examiner* — Mohammed S. Alawadi
(74) *Attorney, Agent, or Firm* — Welsh IP Law LLC

(57) ABSTRACT

The present invention relates to an automatic trimming apparatus (1) for wire coils (2) including a plurality of wire loops (3). The apparatus comprises a base frame (4), a rotational member (6) rotatably connected to the base frame (4), a support unit for supporting the wire loop when the rotational member (6) is rotated, a sensor assembly arranged for detecting the end of the wire and a distance sensor for sensing a distance travelled along the wire when the rotational member is rotated. The trimming apparatus is adapted to rotate the rotational member is in a first direction until the end of the wire is detected, rotate the rotational member in an opposite direction when the end of the wire has been detected, determine the distance travelled along the wire, and generate a cutting command based on the distance travelled along the wire from the end of the wire and a predetermined cutting distance. The rotational member (6) comprises a cutting device arranged to cut the wire upon receiving the cutting command.

13 Claims, 7 Drawing Sheets

(51) Int. Cl.
*B21C 47/22* (2006.01)
*B21C 51/00* (2006.01)

(56) References Cited

U.S. PATENT DOCUMENTS

| | | | | |
|---|---|---|---|---|
| 2008/0072721 | A1* | 3/2008 | Kern | B21F 11/00<br>83/37 |
| 2013/0255823 | A1* | 10/2013 | Brottlund | B68G 15/00<br>140/139 |
| 2019/0291169 | A1 | 9/2019 | Teegavapu | |

* cited by examiner

AUTOMATIC TRIMMING APPARATUS FOR WIRE COILS

TECHNICAL FIELD

The present invention relates to an automatic trimming apparatus for trimming wire coils in long rolling mills.

BACKGROUND

A wire coil is made up by a continuous multitude of loop-shaped wire which is created by a loop-forming device located after a final shape rolling device in a wire rod rolling mill. The continuous length of the looped wire can be several thousand meters. The loop forming device is followed by a conveyor on which the continuous loops are transported until reaching a vertical collection device into which the loops falls and accumulates into a vertical coil.

An important aspect of the product quality in a long rolling mill that produces wire coils is the final material properties of the wire within the coil. Due to activities in the process of manufacturing the wire, such as the rolling process itself, produces wire with differing properties at the head and tail of each coil. The reduced quality of the tail and head of the wire within the coil require their removal before further processing of coils. Coils that have not been trimmed optimally are one factor of poor-quality coils. Thus, the first and last part of the wire in the coil does not meet the quality requirements and must therefore be removed. This process is referred to as coil trimming and can be performed on the coil while supported by a vertical pallet or a horizontal hook.

The most common conventional method to remove the tail and the head of a wire coil includes largely manual activities whereas an operator identifies and separate the part of the wire rod coil that is to be removed. To determine this, the operator can count individual rings based on a specific minimum length defined by the specific production conditions for the specific product. The operator can also conduct a basic inspection and remove additional wire if required. Once the decision to cut at a specific location has been made by the operator, the wire is cut by using some form of cutting device followed by the operator manually lifting and removing the cut part and dispose of it in a designated receptacle. The working environment in this area is prone to injuries and features a generally poor ergonomic working situation.

The second most common conventional method is by using a high-speed shear to remove the front- and end-section of the rolled billet after the wire has received its final size and shape and before the straight wire is formed into its coiled shape. In this area, the high-speed shear must be able to cut at a very high accuracy and at very high relative speed. Such high-speed shear becomes very complex and expensive to maintain and operate. Due to the complex nature of such high-speed shear, it sometimes fails to perform its intended trimming operation and as a consequence, any removal of head- and tail wire must be conducted by a manual operator. Even when the high-speed shear operates as intended, some damage to the wire may occur after the high-speed shear which then requires trimming to be conducted by a manual operator. Whilst the high-speed shear can be very useful, it cannot completely eliminate the need for a back-up system or a manual trimming location.

US2019/0291169, EP0992298A2, GB2047597, and KR101568593B1 discloses prior art trimming apparatus. The prior art trimming apparatus comprises means for determining the number of wire loops to be cut off. A disadvantage such trimming apparatus is that the sheared positions are determined with poor accuracy leading to a waste of wire.

SUMMARY

It is an aim of the present invention to provide an improved automatic trimming apparatus for wire coils, which determines shear positions with increased accuracy.

This aim is achieved by an automatic trimming apparatus as defined in claim 1.

The apparatus comprises:

- a base frame,
- a rotational member rotatably connected to the base frame, and having a space for receiving a wire loop of the coil,
- a first actuator arranged to rotate the rotational member in two opposite directions, and
- a control unit arranged to control the first actuator, and the rotational member is provided with
  - a support unit arranged in said space for supporting the wire loop when the rotational member is rotated,
- a sensor assembly arranged for sensing the presence of a wire in a defined area of the space, and
  - a distance sensor for sensing a distance travelled along the wire during rotation of the rotational member, and the control unit is adapted to:
    - receive outputs from the wire sensor assembly and the distance sensor,
      - detecting the end of the wire based on the output from the wire sensor assembly,
      - control the first actuator so that the rotational member is rotated in a first direction until the end of the wire is detected,
    - control the first actuator so that the rotational member is rotated in a second direction opposite the first direction when the end of the wire has been detected,
    - determine the distance travelled along the wire in the second direction based on the output from the distance sensor, and
      - generate a cutting command based on the distance travelled along the wire from the end of the wire and a predetermined cutting distance.

The rotational member comprises a cutting device and the cutting device is arranged to cut the wire upon receiving the cutting command from the control unit.

Instead of counting individual rings of the coil as in the prior art, the trimming apparatus according to the invention searches for the end of the wire in the coil while rotating along the wire in one direction, and when the end of the wire has been found, the distance travelled from where the end of the wire was detected is measured while rotating along the wire in the opposite direction. The distance travelled from the end of the wire is compared to a predetermined cutting distance. The predetermined cutting distance corresponds to a desired cutting length of the wire. This makes it possible to find the exact trimming point on the wire with high accuracy. The accuracy in locating the point of trimming guarantee that no excess wire is removed from the coil.

The preestablished cutting distance can be defined beforehand based on calculating the optimal trimming position on the wire. A cutting length of the wire is the length of the wire from the end of the wire to the defined optimal trimming position on the wire. The cutting length is a variable parameter and is preferably determined by the user of the trimming apparatus and is normally a function of final rolling velocity of the wire and a specific rolling time which is calculated into a specific distance, or it could be a specific distance based on the physical dimensions of a rolling mill production apparatus. Based on the specific wire diameter, the nominal looped ring diameter, the cutting length plus the physical distance between the sensor assembly and the actual cutting location, the cutting distance can be calculated.

The sequential operating process of the trimming apparatus eliminates errors. The point of trimming will always be exactly as instructed, i.e. according to the predetermined cutting distance.

The trimming apparatus can perform the trimming after the continuous mill production. Unlike trimming equipment located within the actual continuous mill, the trimming apparatus according to the invention performs the trimming immediately after the coil has left the continuous mill.

According to an aspect of the invention, the support unit comprises a drive roller and a pinch roller arranged movable with respect to the drive roller in a radial direction of the rotational member to allow the wire loop to be clamped between the drive roller and the pinch roller. Thus, the position of the wire in a radial direction of the rotational member is fixed while the rotational member is rotating with respect to the wire.

According to an aspect of the invention, the drive roller and the pinch roller are rotatably arranged with respect to the rotational member, and the drive roller and the pinch roller are arranged so that they rotate in opposite directions with respect to each other when the wire is clamped between them and the rotational member is rotated in any of the first and the second directions. The drive roller and the pinch roller are rolled along the wire while the rotational member is rotated. Thus, unintentional damage of the wire is avoided when the support unit clamps the wire during rotation of the rotational member with respect to the wire. The friction between the wire and the drive roller and pinch roller is reduced due to the fact that the roller rotates along the wire instead of sliding along the wire.

According to an aspect of the invention, the apparatus comprises a second actuator arranged to rotate the drive roller in two opposite directions, and the control unit is adapted to control the first and second actuators so that the drive roller and the rotational member are rotated in the same direction in a synchronized manner.

While the rotational member is rotating in the first direction, the drive roller is driving the wire in the opposite direction in a synchronized manner between the two rotating motions, resulting in un-scrambling of the different wire loops along the coil loop axis while not changing the actual geometry of each individual loop in the radial direction while simultaneously organizing the individual loops in a successive order, one after another starting with the last looped ring in the plurality of looper rings closest to the rotational member of the trimming apparatus.

According to an aspect of the invention, the rotational member is arranged rotatable with respect to the base frame about a first rotational axis, the drive roller is arranged rotatable with respect to a second rotational axis, and the pinch roller is arranged rotatable with respect to a third rotational axis, and the first, second, and third rotational axes are in parallel.

According to an aspect of the invention, the cutting device comprises an accommodation with an opening arranged to receive the end of the wire when the rotational member is rotated in the second direction, the cutting device comprises a movable steel cutter, and the cutting device is arranged to move the steel cutter upon receiving the cutting command so that the wire in the accommodation is cut.

According to an aspect of the invention, the steel cutter is arranged movable with respect to the opening in an axial direction of the rotational member.

According to an aspect of the invention, the control unit is adapted to control the first and second actuators so the rotational member and the drive roller are rotated in the first direction in a synchronized manner until the end of the wire has been detected, and to control the first and second actuators so that the rotational member and the drive roller are rotated in the second direction after the end of the wire has been detected.

The control unit is adapted to control the first and second actuators so that the rotational member and the drive roller are rotated in the second direction until the distance travelled along the wire from the end of the wire was detected corresponds to the predetermined cutting distance. The control unit is adapted to generate the cutting command when the distance travelled along the wire in the second direction from the end of the wire was detected corresponds to the predetermined cutting distance. The cutting device has then reached the optimal cutting point along the wire and will receive the cutting command from the control unit. The control unit is adapted to control the first and second actuators so that the rotational member and the drive roller are rotated in the second direction until the distance travelled along the wire from the end of the wire correspond to the predetermined cutting distance. The cutting distance is calculated based on the position of the cutting device so that the steel cutter of the cutting device is facing the optimal cutting point on the wire.

According to an aspect of the invention, the rotational member is provided with a wire receiving guide for receiving a wire loop, and the wire receiving guide is arranged movable between an extended position outside the space and a retracted position inside the space. The wire receiving guide moves the wire from the outside of the rotational member to the space inside the rotational member.

According to an aspect of the invention, the wire receiving guide has a recess for receiving the pinch roller in the retracted position, the wire receiving guide is arranged linearly movable with respect to the pinch roller in an axial direction of the rotational member, and the pinch roller is arranged linearly movable with respect to the recess in the radial direction of the rotational member. The recess makes it possible for the pinch roller to move with respect to the wire receiving guide, when the wire receiving guide is in the retracted position and so that the pinch roller can clamp the wire between the pinch roller and the drive roller.

According to an aspect of the invention, the wire receiving guide is arranged so that the wire is positioned between the drive roller and pinch roller in the retracted position. Thus, it is possible to clamp the wire between the pinch roller and the drive roller.

According to an aspect of the invention, the wire receiving guide is provided with an elongated groove for receiving the wire loop.

According to an aspect of the invention, the distance sensor is a pulse-encoder arranged to detect the rotational motions of the drive roller. The distance moved can, for example, be calculated based on the number of revolutions of the drive roller. This will provide high accuracy of the distance measurement.

BRIEF DESCRIPTION OF THE DRAWINGS

The invention will now be explained more closely by the description of different embodiments of the invention and with reference to the appended figures.

DETAILED DESCRIPTION

Figure 1:
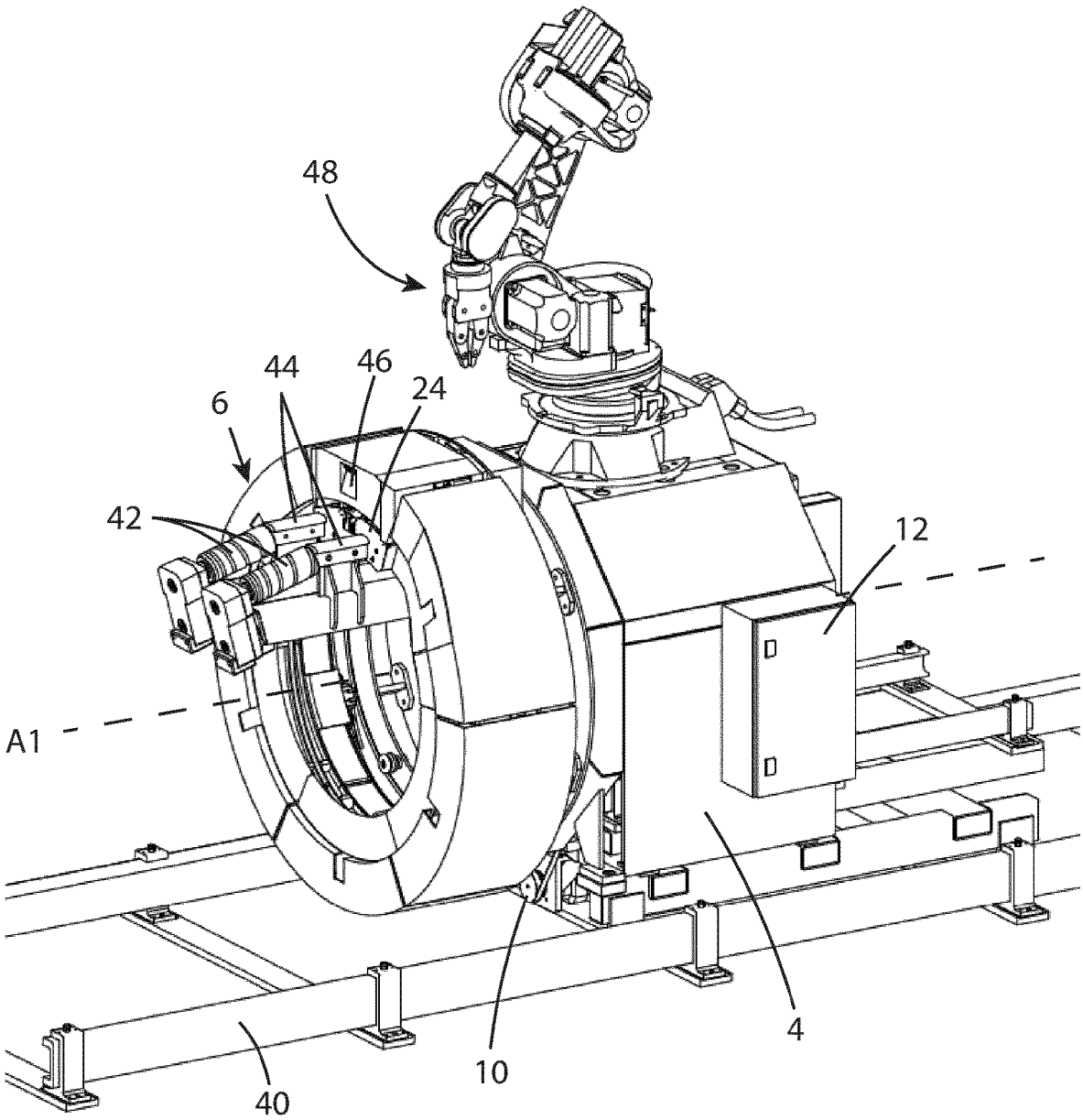
FIG. 1 shows an example of an automatic trimming apparatus in a perspective view.

Aspects of the present disclosure will be described more fully hereinafter with reference to the accompanying drawings. The trimming apparatus can, however, be realized in many different forms and should not be construed as being limited to the aspects set forth herein. Like numbers in the drawings refer to like elements throughout.

FIG. 1 shows an example of an automatic trimming apparatus 1. The trimming apparatus 1 is designed to cut and remove a specific amount of wire from an end of a coil including a plurality of wire loops. The specific amount of wire to be cut and removed is contingent on physical and geometrical conditions of the wire as well as specific production parameters at the manufacturing location. The specific amount of wire to be cut and removed can be determined beforehand. The length of the specific amount of wire to be cut and removed from the end of the wire is in the following called the desired cutting length. The cutting length can vary due to the type and size of the coil and depends on the type of production machines in the wire rod rolling mill. The cutting length typically varies between 200 mm up to 20 m. The cutting length of the wire can be determined based on a previously established optimal trimming position on the wire.

The trimming apparatus 1 comprises a base frame 4, a rotational member 6 rotatably connected to the base frame 4, a first actuator 10 arranged to rotate the rotational member 6 in two opposite directions, and a control unit 12 arranged to control the first actuator 10 and accordingly to control the rotational motions of the rotational member 6. The rotational member 6 is substantially ring shaped. The rotational member 6 is arranged so that it is able to rotate around its center-axis A1. The direction of the rotation can be either clockwise or counter-clockwise. The interior of the rotational member 6 is described later with reference to FIGS. 2 and 3.

Figure 4:
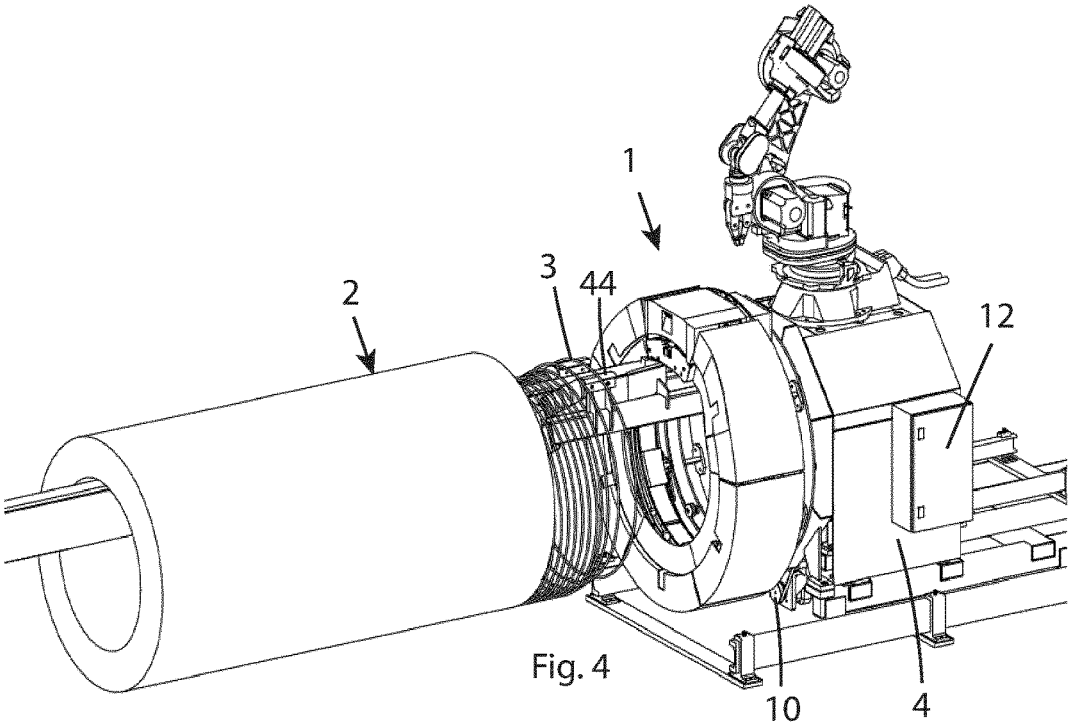
FIG. 4 shows and the trimming apparatus and a wire coil with wire loops in the tail separated.

In this example, the trimming apparatus 1 is arranged on a floor mounted rail 40 onto which the trimming apparatus 1 is running supported on roller wheels. The trimming apparatus 1 is propelled in both directions along the extension of the rail by means of an electric motor (not shown). The rotational member 6 comprises a wire separation unit adapted to separate the wire loops in the coil from each other, and by that make it possible to pick one of the wire loops from the coil. Several types of wire separation units are known in the art. In this example, the wire separation unit comprises two separating rollers 42. The separating rollers 42 are mounted at a shallow angle in relation to the horizontal plane and is powered by an electrical motor. Each separating roller 42 is equipped with a helical shaped groove with a gradually increasing pitch. Each separating roller groove is mirrored to the other separating roller groove and is intended to rotate in opposite directions to each-other. The combined effect of these mirrored gradually increasing grooves rotating in opposite directions is intended to transport the individual wire loops along the angled separating roller 42 while gradually increasing the space between the individual loops, as shown in FIG. 4. It is also possible to use other types wire separation units. After the separating rollers 42 there is a horizontal landing surface 44 onto which the separated wire loops 3 will be accumulated as the process proceeds.

The base frame 4 supports the rotational member 6, which is able to rotate around its center-axis A1 by means of the first actuator 10. The first actuator 10 is, for example, an electrical motor equipped with a teethed sprocket wheel. The first actuator 10 is attached to the base frame 4. The torque from the electrical actuator 10 is, for example, applied to a large sprocket connected to rotational member 6 by means of a teethed belt, thus making the rotational member 6 to rotate. Optionally, the rotational member 6 is equipped with a vision sensor 46 arranged to identify a single wire loop resting on the landing surface 44 within the plurality of wire loops.

The rotational member 6 is provided with a wire receiving guide 24 for receiving a wire loop. The wire receiving guide 24 is arranged movable between an extended position on the outside of the rotational member 6 and a retracted position inside the rotational member 6 by means of an actuator 25, shown in FIG. 7*a*. The wire receiving guide 24 is arranged linearly movable in an axial direction with of the rotational member 6. The wire receiving guide moves the wire from the outside of the rotational member to the space inside the rotational member.

The trimming apparatus 1 may further comprise a gripping device 48 adapted to grab the identified single wire loop on the landing surface 44 and to place the single wire loop selected from the plurality of wire loops into the wire receiving guide 24 when the wire receiving guide is in the extended position on the outside of the rotational member 6. In this example, the gripping device 48 is a multi-axis robotic arm equipped with a gripper used to grab and move the identified single wire loop. However, other known types of devices for gripping and moving items can be used.

Figure 2:
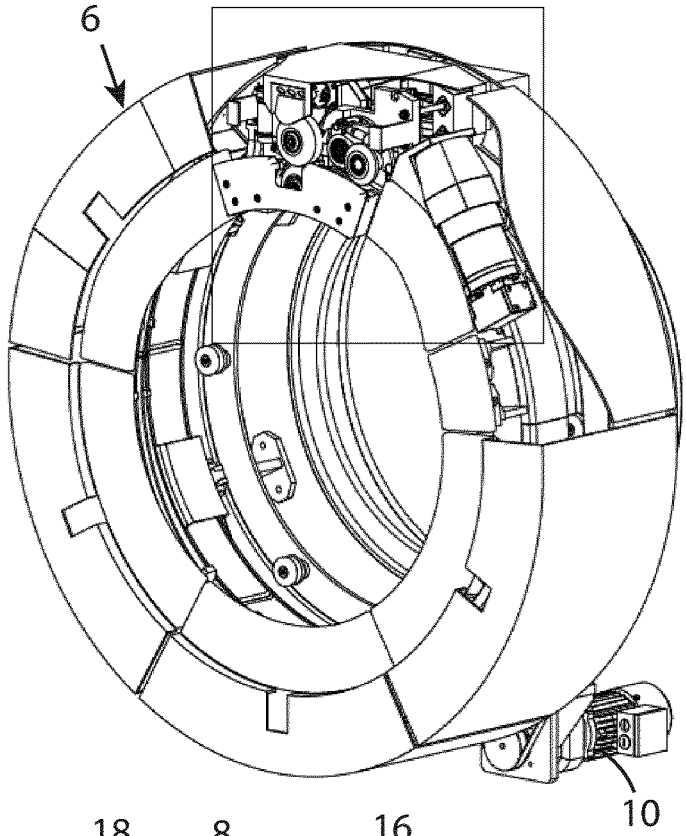
FIG. 2 shows an example of a rotational member of the trimming apparatus in a perspective view with a part removed to show the interior of the rotational member.
Figure 3:
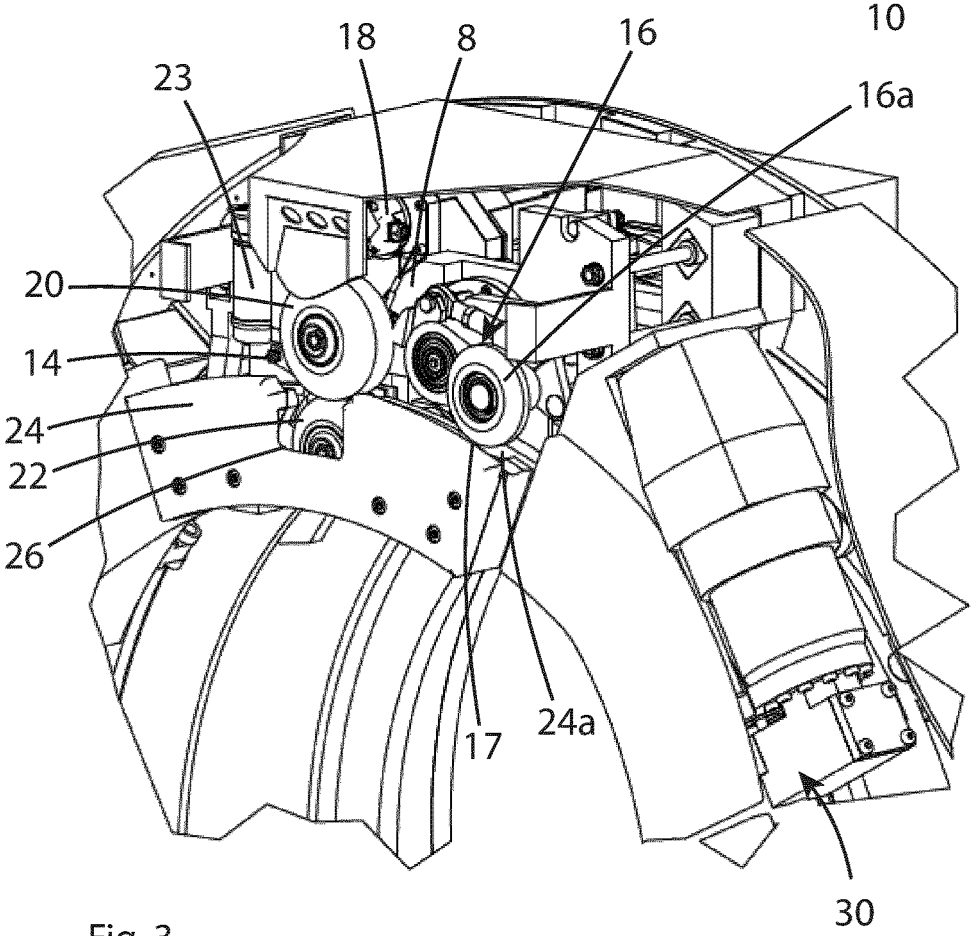
FIG. 3 shows an enlarged part of the interior of the rotational member.

FIG. 2 shows an example of the rotational member 6 in a perspective view with a part removed to show the interior of the rotational member. FIG. 3 shows an enlarged part of the interior of the rotational member 6. The interior of the rotational member 6 defines a space 8 for receiving a wire loop of the coil. The rotational member 6 comprises a support unit 14 arranged in the space 8 for supporting the wire loop 3 in the space 8 when the rotational member 6 is rotated. The support unit 14 is arranged to move along the wire of the coil while the rotational member 6 is rotating. The rotational member 6 and the support unit 14 are moved relative the wire while the rotational member 6 is rotating. The wire loop supported by the support unit stays still during the rotation of the rotational member.

The rotational member 6 comprises a sensor assembly 16 arranged in the space 8 for sensing the presence of a wire in a defined area 17 of the space 8. The sensor assembly 16 is disposed at a distance from the support unit 14 so that the end of the wire is detected before it reaches the support unit 14. The rotational member may comprise two or more sensor assemblies 16 to allow optimization of the process speed and to achieve redundancy. The distance between the support unit 14 and the defined area 17 is known. The rotational member 6 further comprises a distance sensor 18 for sensing a distance travelled along the wire during the rotation of the rotational member 6.

The rotational member 6 further comprises a cutting device 30 arranged to cut the wire upon receiving a cutting command from the control unit 12. For example, the cutting device 30 comprises an electro-hydraulic cutter. The cutting device 30 is attached to the rotational member 6. The cutting device 30 is disposed a distance from the support unit 14. The cutting device 30 is also disposed a distance from defined area 17.

The control unit 12 comprises processing circuitry for processing sensor data received from the sensor assembly 16 and the distance sensor 18 and for sending instructions to the components it is controlling, such as actuators 10, 21, 23, 25 and the cutting device 30. Communication between the control unit 12 and the sensors 16, 18 and the components it is controlling, may comprise wired or wireless communication. The control unit 12 may comprise software code portions, such as a computer program, comprising instructions for carrying out steps of the invention, and hardware, such as a processor, memory and input/output devices, for carrying out the instructions of the software code portions.

The control unit 12 is adapted to generate a cutting command to the cutting device 30 based on a predetermined cutting distance. The predetermined cutting distance can be determined beforehand based on a predetermined optimal trimming position on the wire. A cutting length of the wire is the length of the wire from the end of the wire to the predetermined optimal trimming position on the wire. The cutting length is a variable parameter and can be determined by the user of the trimming apparatus. The cutting distance can be calculated based on the desired cutting length, the specific wire diameter, the nominal wire loop diameter and the position of the support unit 14, the position of the sensor assembly 16, and the position of the cutting device 30. The control unit 12 may comprise a data storage for storing the predetermined cutting distance. The control unit can be adapted to receive the predetermined cutting distance and to store it in the data storage. Alternatively, the control unit can be adapted to receive the desired cutting length and to calculate the cutting distance based on the cutting length.

The control unit 12 is adapted to receive outputs from the sensor assembly 16 and the distance sensor 18. The control unit 12 is adapted to detect the end of the wire 3*a* based on the output from the wire sensor assembly 16, to control the first actuator 10 so that the rotational member 6 is rotated in a first direction until the end of the wire is detected, to control the first actuator 10 so that the rotational member 6 is rotated in a second direction opposite the first direction when the end of the wire has been detected, to determine the distance travelled along the wire when the rotational member is rotated in the second direction based on the output from the distance sensor 18, and to generate a cutting command based on the distance travelled along the wire from the end of the wire and the predetermined cutting distance. The control unit 12 is adapted to compare the distance travelled in the second direction with the predetermined cutting distance, and to generate the cutting command when the distance travelled along the wire in the second direction corresponds to the predetermined cutting distance.

Figure 7A:
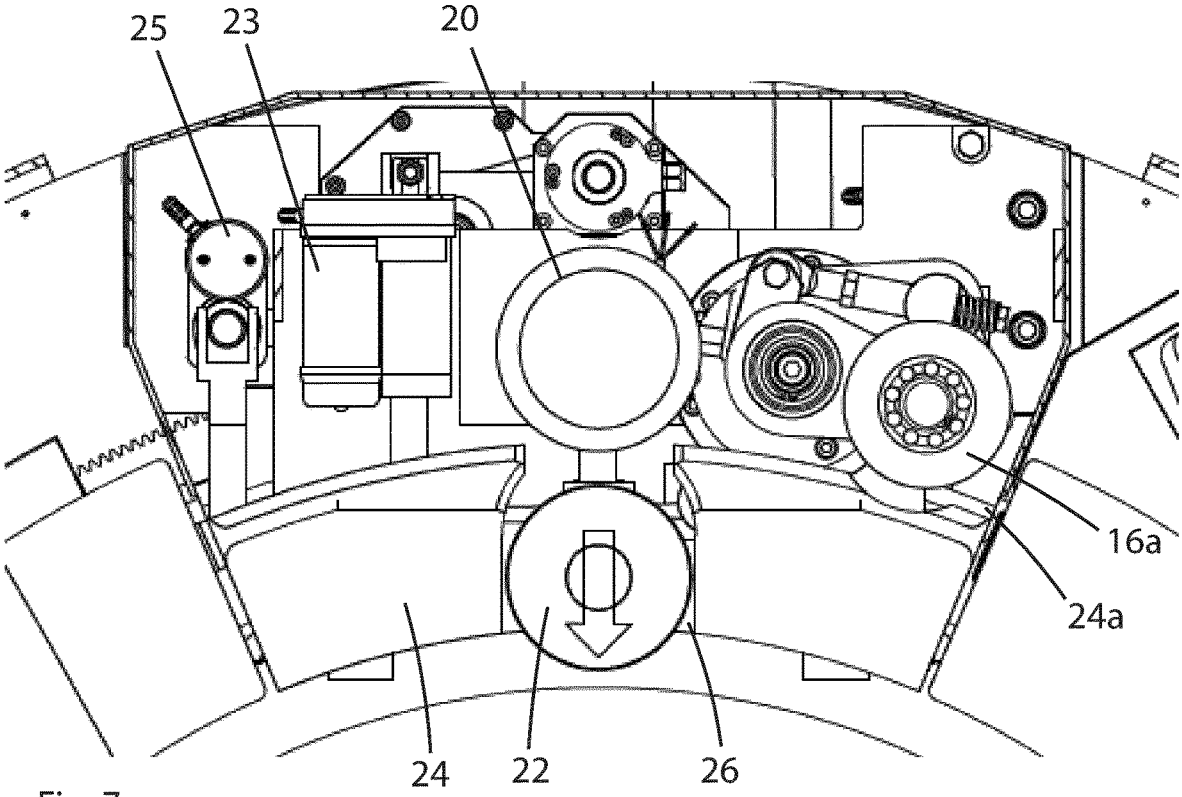
FIGS. 7*a-b* illustrate a pinch roller arranged movable with respect to a drive roller so that the wire can be clamped between them.
Figure 7B:
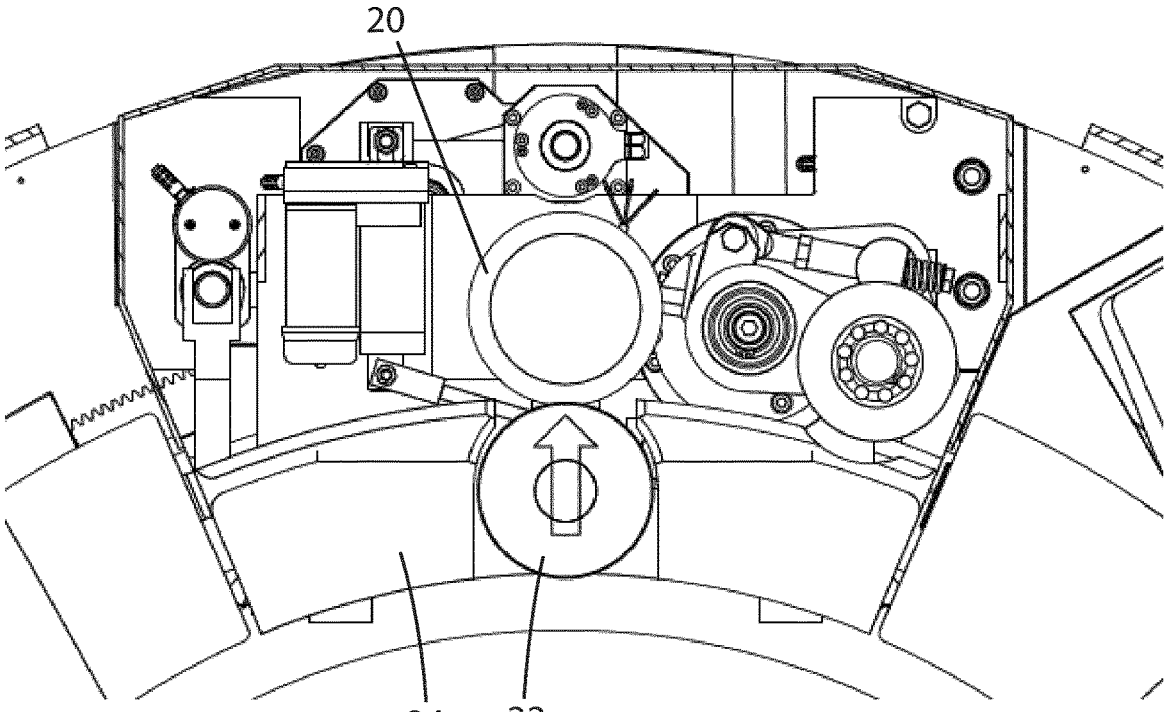

The support unit 14 is arranged to move along the wire while the rotational member 6 is rotating. The rotational member 6 and the support unit 14 are moving relative the wire. The support unit 14 comprises a drive roller 20 and a pinch roller 22 rotatably connected to the rotational member 6. The trimming apparatus comprises a second actuator 21 arranged to rotate the drive roller 20 in two opposite directions, shown in FIG. 8. The second actuator 21 is, for example, an electric motor. The pinch roller 22 is arranged linearly movable with respect to the drive roller 20 in a radial direction of the rotational member, as shown in FIG. 7*a-b*, to allow the wire loop to be clamped between the drive roller 20 and the pinch roller 22, as shown in FIG. 9. Thus, the position of the wire in a radial direction of the rotational member is fixed while the rotational member 6 is rotating with respect to the wire. The rotational member 6 comprises an actuator 23 arranged to move the pinch roller 22 towards and away from the drive roller 20.

The wire receiving guide 24 has a recess 26 for receiving the pinch roller 22 in the retracted position. The wire receiving guide 24 is arranged linearly movable with respect to the pinch roller 22 in an axial direction of the rotational member 6. The pinch roller 22 is arranged linearly movable with respect to the recess 26 in the radial direction of the rotational member 6. Due to the recess 26, the pinch roller is allowed to move towards and away from the drive roller 20 when the wire receiving guide 24 is in the retracted position. The receiving guide 24 has an exit 24*a* for the wire arranged in one end.

The drive roller 20 and the pinch roller 22 are arranged so that they rotate in opposite directions with respect to each other when the wire is clamped between them, and the rotational member 6 is rotated in any of the first and the second directions as shown in figures and 11. Thus, the drive roller 20 and the pinch roller 22 are rolled along the wire 3 while the rotational member 6 is rotated. Thus, unintentional damage of the wire is avoided when the support unit 14 clamps the wire during rotation of the rotational member 6. The friction between the wire and the drive roller 20 and the pinch roller 22 is reduced due to the fact that the drive roller 20 and the pinch roller 22 rotate along the wire instead of sliding along the wire.

The control unit 12 is adapted to control the first and second actuators 10, 21 so that the drive roller 20 and the rotational member 6 are rotated in the same direction in a synchronized manner to allow the drive roller 20 and the pinch roller 22 to roll on the wire while the rotating member 6 is rotated relative the wire. In this example, the pinch roller 22 has no actuator. The pinch roller 22 is rotated due to the friction against the wire and the movements of the rotating member 6.

The rotational member 6 is arranged rotatable with respect to the base frame 4 about a first rotational axis coinciding with the central axis A1. The drive roller 20 is arranged rotatable with respect to a second rotational axis in parallel with the central axis A1, and the pinch roller 22 is arranged rotatable with respect to a third rotational axis in parallel with the central axis A1, and the first, second, and third rotational axes are in parallel.

Figure 9:
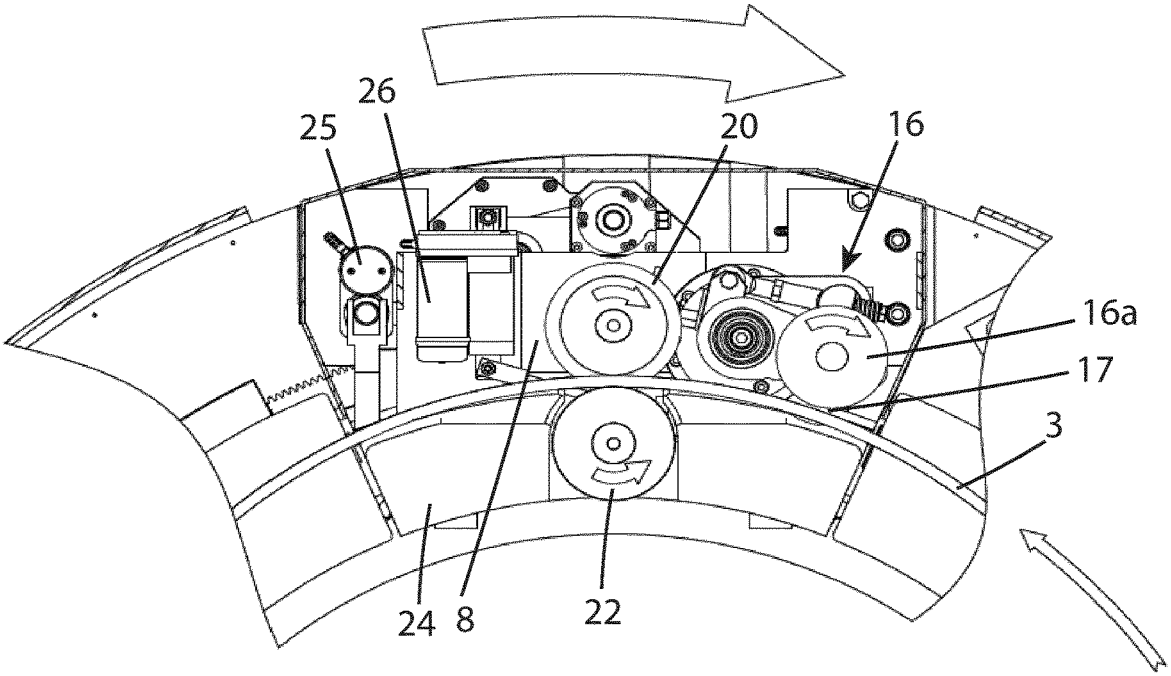
FIG. 9 illustrates in a front view the motions of the rotational member when the trimming apparatus rotates clockwise while unscrambling the wire loops and searching for the end of the wire.
Figure 10:
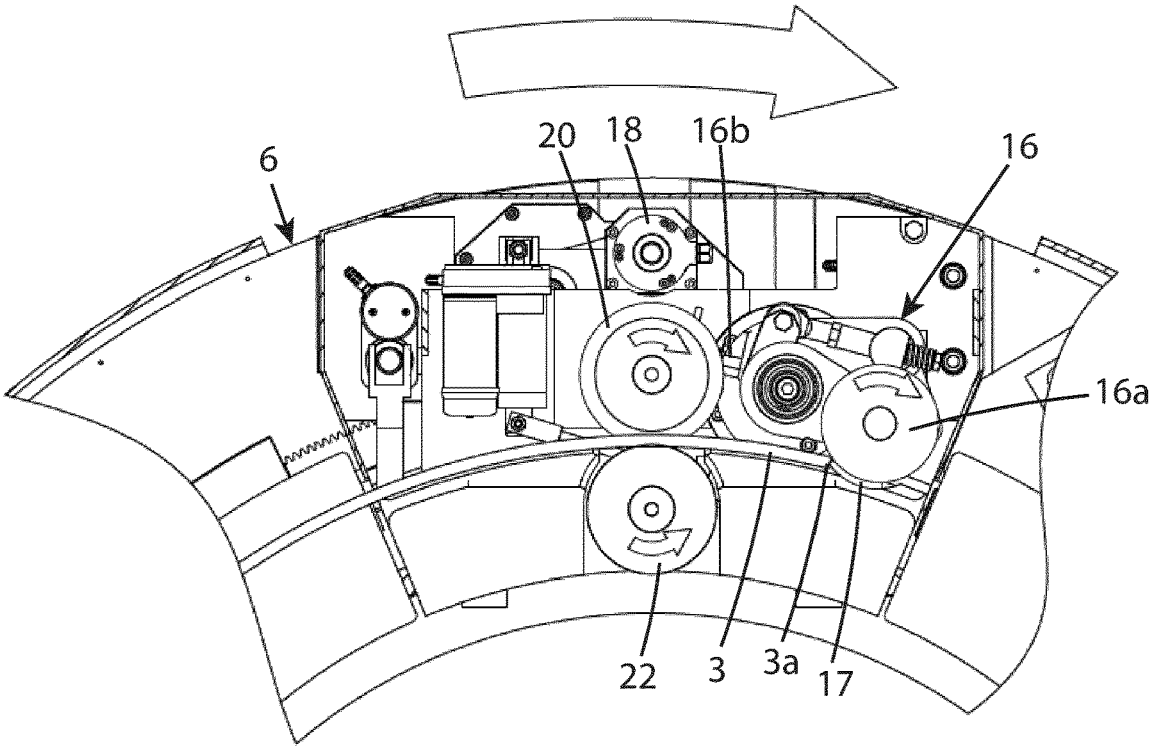
FIG. 10 shows the rotational member upon detecting the end of the wire.
Figure 11:
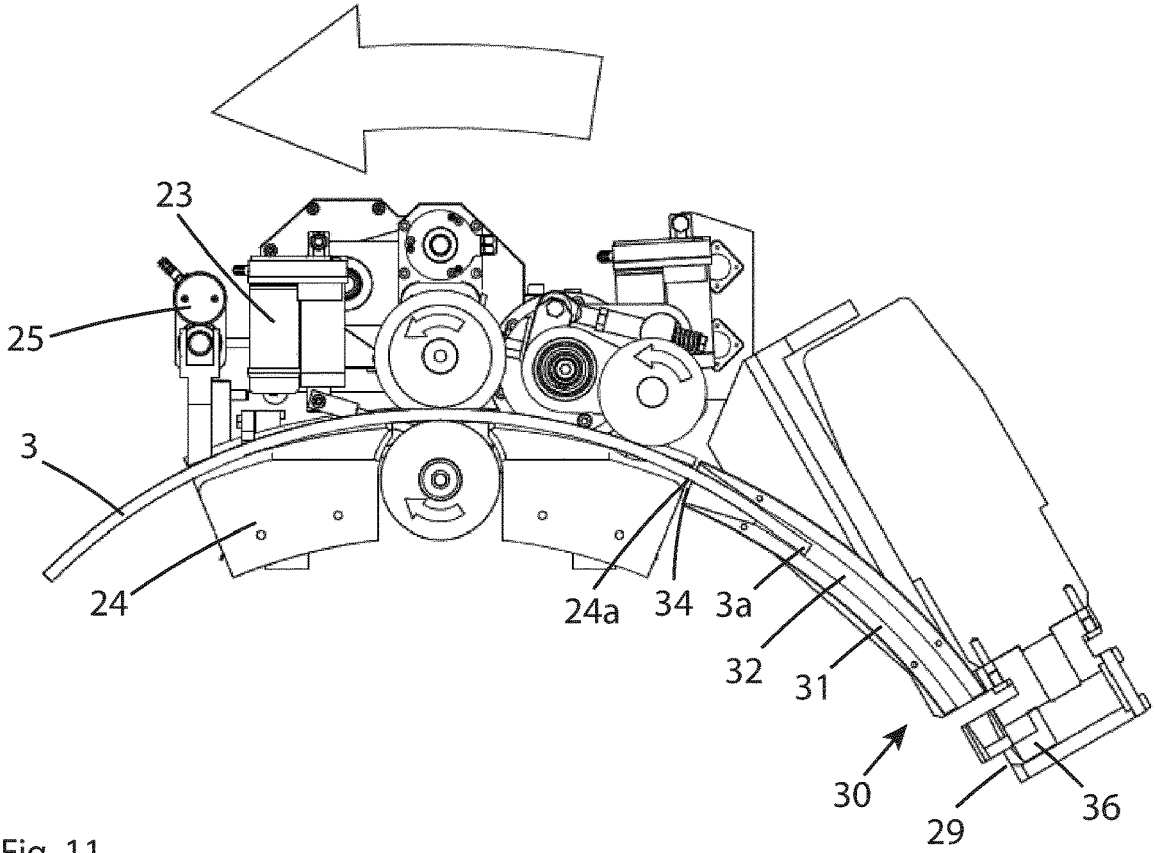
FIG. 11 shows a cross-section through the rotational member and a cutting device when the rotational member is rotating in a counter-clockwise direction after the end of the wire has been detected.

The control unit 12 is adapted to control the first and second actuators 10, 21 so that the rotational member 6 and the drive roller 20 are rotated in the first direction in a synchronized manner until the end of the wire 3*a* has been detected, as shown in FIGS. 9 and 10, and to control the first and second actuators 10, 21 so that the rotational member 6 and the drive roller 20 are rotated in the second direction after the end of the wire 3*a* has been detected, as shown in FIG. 11. The control unit 12 is adapted to control the first and second actuators 10, 21 so that the rotational member 6 and the drive roller 20 are rotated in the second direction until the distance travelled along the wire corresponds to the predetermined cutting distance. The control unit 12 is adapted to stop the rotational movements of the rotational member 6 and the drive roller 20 and to generate the cutting command when the support unit 14 has travelled the predetermined cutting distance along the wire in the second direction.

The sensor assembly 16 is arranged to detect when the end of the wire 3*a* is present in the defined area 17. The sensor assembly 16 can be arranged for sensing the presence of the wire 3 in the defined area 17 of the space 8, as shown in FIG. 9, and also to detect when the wire 3 is no longer present in the defined area 17, as shown in FIG. 10. The sensor assembly 16 is used to detect the end of the wire 3*a*. For example, the output from the sensor assembly 16 stays 1 as long as the wire 3 is sensed in the defined area 17, and the output from the sensor assembly 16 is switched to 0 when the wire is no longer present in the defined area. Thus, it is possible for the control unit 12 to detect when the end of the wire 3*a* has passed through the defined area 17. Different types of sensor can be uses to detect the end of the wire. For example, the sensor assembly 16 may comprise an optical sensor adapted to detect when the end of the wire is present in the defined area 17. In this example, the sensor assembly comprises a sensor roller 16*a* and an inductive sensor 16*b* arrange to detect when the sensor roller 16 is moved downwards, as shown in FIG. 10. The sensor roller 16*a* is spring tensioned so that the sensor roller is biased towards the wire. The sensor roller 16*a* is arranged so that it rolls on the wire 3 as long as the wire is present in the area 17, as shown in FIG. 9. When the end of the wire 3*a* is present in the area 17, the sensor roller 16*a* rolls off the wire and is moved a short distance towards the centre of the rotating member due to the spring force acting on the sensor roller 16, as shown in FIG. 10. The inductive sensor 16*b* is arranged to detect the movement of the sensor roller 16*a*. This type of sensor assembly is known in the art.

The distance sensor 18 can be arranged in different ways. For example, the distance sensor 18 can be arranged to detect the distance travelled by the support unit 14 along the wire. In one example, the distance sensor 18 can be an electrical pulse-encoder connected to the driven roller 20 and arranged to detect the rotational motions of the drive roller 20. Thus, the actual length of wire passing through the support unit 14 can be measured. The distance sensor 18 can, for example, be arranged to detect the number of revolutions of a drive axis of the motor 21 actuating the drive roller 20. The control unit 12 receives outputs from the distance sensor 18 and determines the distance travelled along the wire in the second direction based on the received output from the sensor 18. In this example, the distance sensor 18 senses the distance travelled by the drive roller 20 along the wire. Other examples could be to connect a distance sensor of electrical pulse-encoder type, to the sensor roller 16*a* or to the pinch roller 22. In these examples, the actual length of wire passing through the sensor assembly can be measured on non-powered rotating members.

FIG. 4 shows the trimming apparatus 1 and a coil 2 comprising a plurality of circular wire loops 3. A wire loop 3 consists of a wire. FIG. 4 shows the coil with the wire loops 3 separated at an end facing the trimming apparatus 1. One of the wire loops 3 is disposed on the horizontal landing surface 44.

Figure 5:
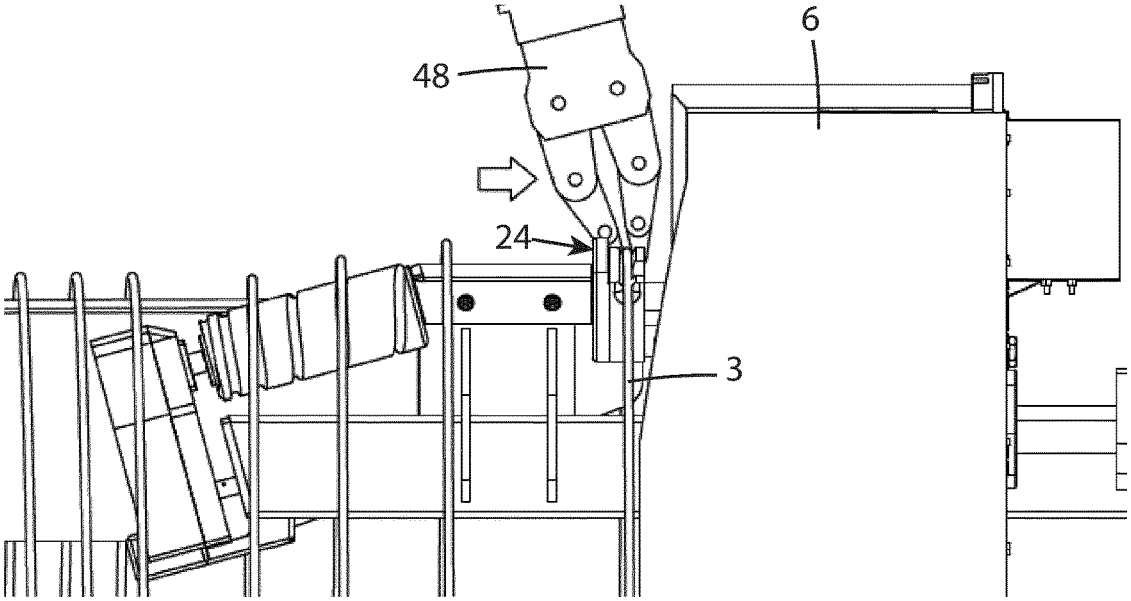
FIG. 5 illustrates a gripping device of the trimming apparatus placing a wire loop in a receiving guide.

FIG. 5 illustrates when the trimming apparatus receives a single wire loop 3 of the wire coil. The receiving guide 24 is in the extended position on the outside of the rotational member 6.

Figure 6:
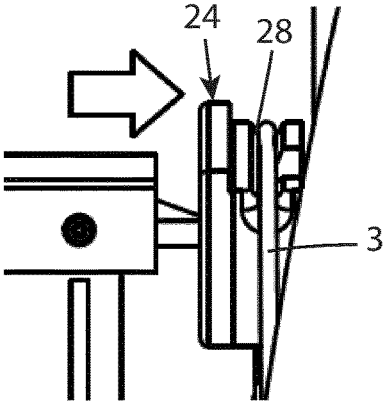
FIG. 6 shows the wire loop positioned in the receiving guide.

FIG. 6 shows the wire receiving guide 24 in a side view. The wire receiving guide 24 is provided with an elongated groove 28 for receiving the wire loop 3. The gripping device 48 positions the wire loop 3 in the groove 28 of the wire receiving guide 24, as shown in FIG. 5. Upon receiving the single wire loop 3 in the groove 28, the control unit 12 activates the actuator 25 to retract the wire receiving guide 24 to its retracted position.

FIGS. 7*a-b* shows the interior of the rotational member 6 in a front view. The pinch roller 22 is arranged movable with respect to the drive roller 20 so that the wire loop 3 can be clamped between them. The control unit 12 activated the actuator 23 to press the pinch roller 22 against a part of the looped wire 3 within the wire receiving guide 24 and against the drive roller 20. A different actuator (not shown) is activated to press the sensor roller 16*a* against another part of the wire within the wire receiving guide 24, as shown in FIG. 9.

Figure 8:
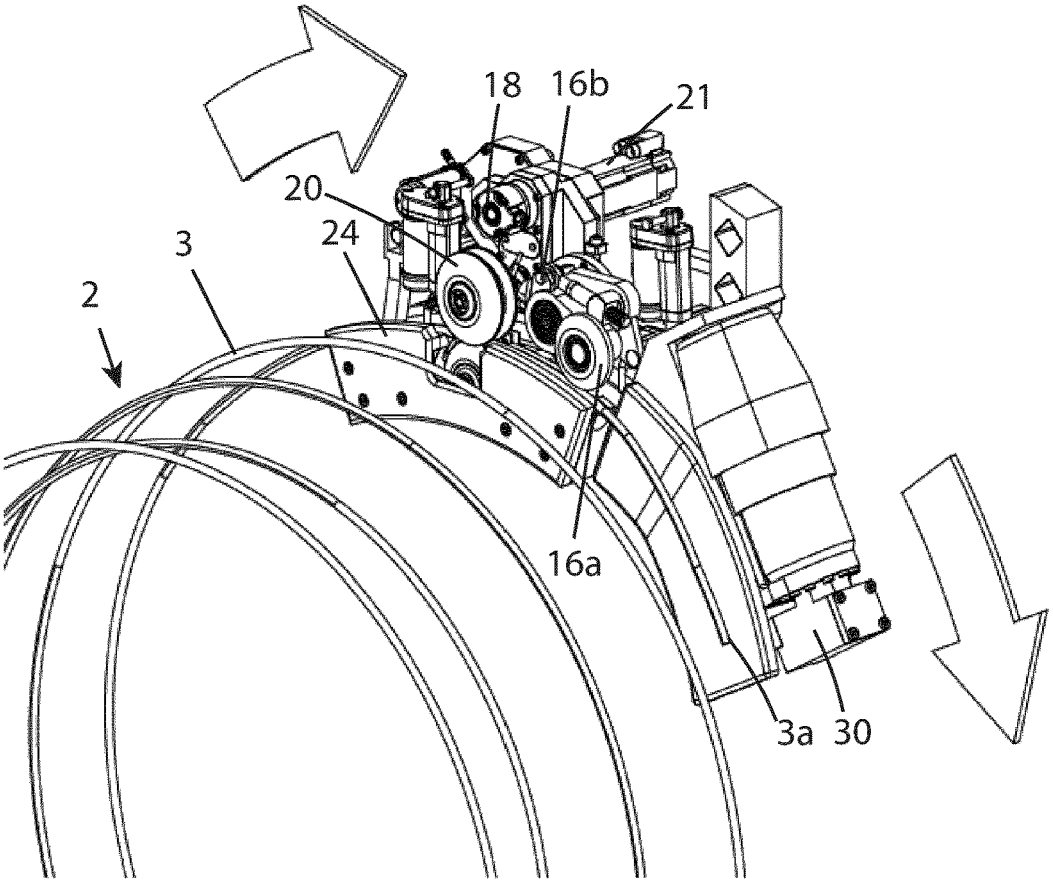
FIG. 8 shows in a perspective view of a part of the rotational member rotating along the wire loop in a clockwise direction while searching for the end of the wire.

FIG. 8 shows a part of the rotational member 6 rotating along the wire loop 3 to find the end of the wire 3*a*. The rotational member 6 begins to rotate around its centre axis A1 by means of the electrical motor 10 attached to the base frame 4. The direction of the rotation can be either clockwise or counter-clockwise, depending on the specific production parameters when producing the coiled loops. While the rotational member 6 is rotating in one direction, the driven roller 20, powered by the actuator 21, is arranged to rotate along the looped wire in the same rotational direction in a synchronized manner between the two rotating motions, resulting in axially un-scrambling of the different wire loops while not changing the actual geometry of each individual loop in the radial direction while simultaneously organizing the wire loops in a successive order, one after another starting with the last wire loop in the plurality of wire loops closest to the rotational part 6 of the trimming apparatus. These rotating motions continues until the sensor roller 16*a* detects the end 3*a* of the last wire loop in the coil and activates the inductive sensor 16*b*.

FIG. 9 illustrates the motions of the rotational member 6, the drive roller 20, the pinch roller 22, and the sensor roller 16*a* when the trimming apparatus is searching for the end of the wire. The rotational member 6 is rotated in a first direction. As seen from the figure, the drive roller 20 and the pinch roller 22 rotate in opposite directions, and the rotational member 6, the drive roller 20, and the sensor roller 16*a* rotate in the same directions. The drive roller 20, the pinch roller 22, and the sensor roller 16*a* are in physical contact with the wire 3. The drive roller 20 and the pinch roller 22 are moving along the wire in the first direction and towards the end of the wire 3*a*.

FIG. 10 shows interior of the rotational member 6 upon detecting the end of the wire 3*a*. The sensor roller 16*a* is moved downwards due to the spring tension when the sensor roller 16*a* has passed the end of the wire, and the inductive sensor 16*b* detects the change of position of the sensor roller 16*a*. The control unit 12 receives information on that the end of the wire has been detected from the inductive sensor 16*b*. The control unit 12 send orders to the first and second actuators 10, 21 to change the direction of the rotation of the rotational member 6 and the drive roller 20 upon receiving the information that the end of the wire has been detected.

FIG. 11 illustrates the motions of the rotational member 6, the drive roller 20, the pinch roller 22, and the sensor roller 16*a* after the end of the wire 3*a* has been detected. The rotational member 6 and the drive roller 20 are now rotated in the second direction, opposite the first direction. The drive roller 20 and the pinch roller 22 are moving along the wire in the second direction and away from the end of the wire 3*a*. During the rotation of the rotational member 6 in the second direction, the distance sensor 18 measures the distance travelled along the wire. The rotation of the rotational member 6 continues until the distance travelled along the wire in the second direction is equal to the predetermined cutting distance. The rotational member 6 can be rotated several turns until the distance travelled along the wire is equal to the predetermined cutting distance.

Figure 12A:
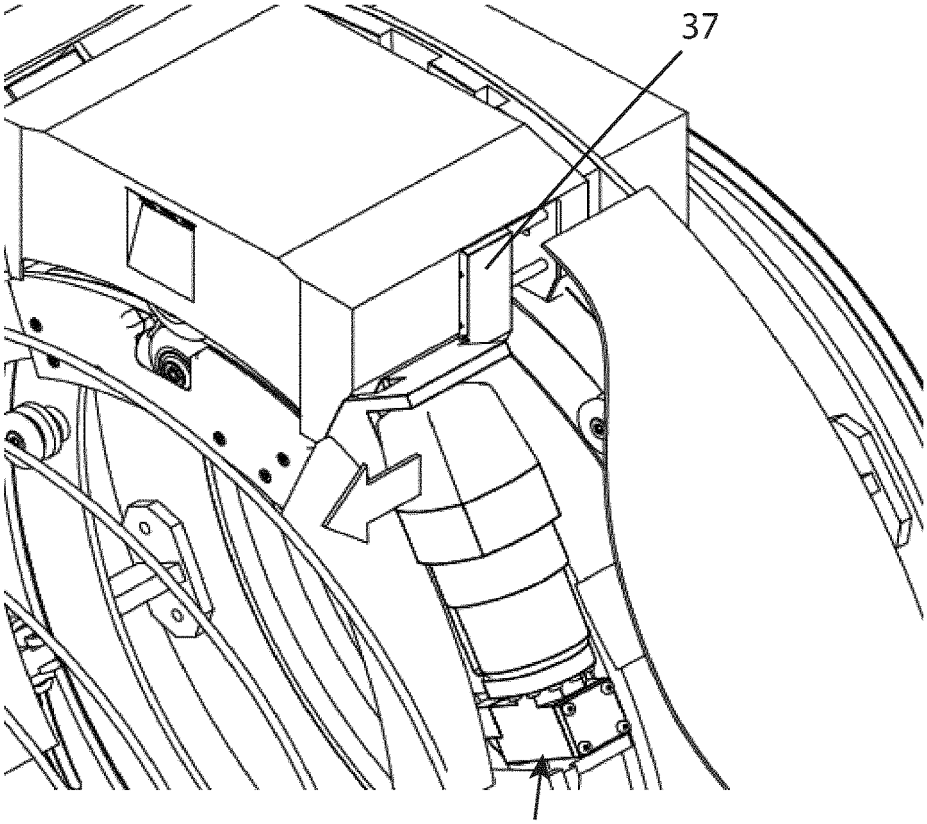
FIG. 12*a* shows the cutting device moving to a forward position for receiving the wire when the end of the wire has been detected.
Figure 12B:
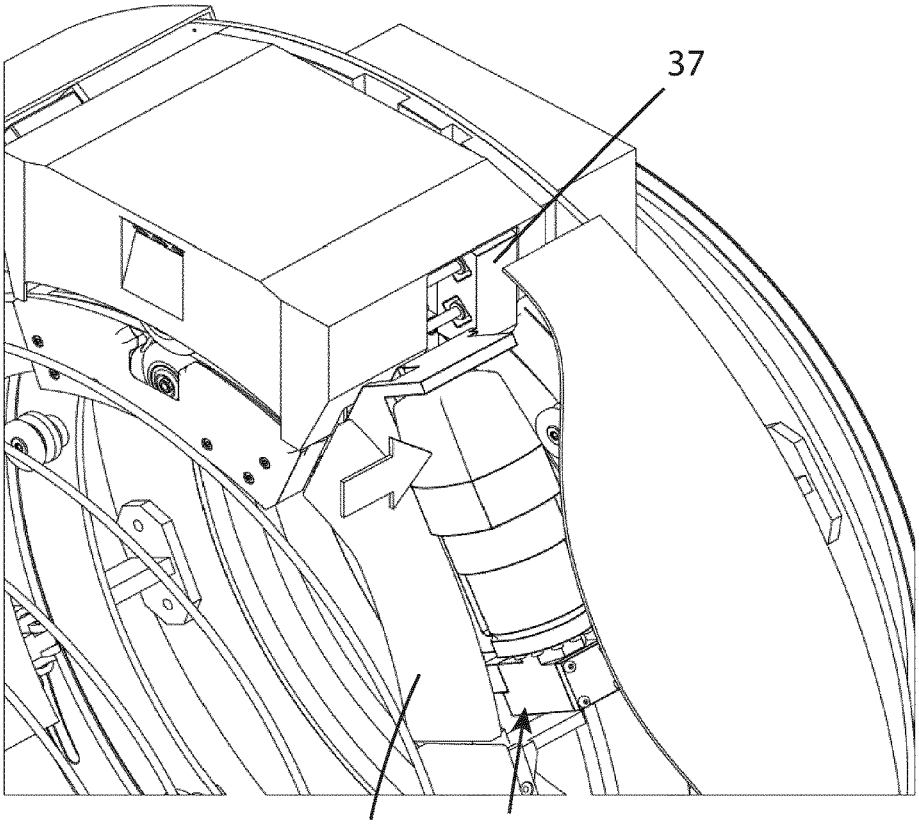
FIG. 12*b* shows the cutting device returning to a retracted position after the wire has been cut.

FIG. 11 shows a cross-section through the rotational member 6 including an example of a cutting device 30. The cutting device 30 comprises a cutter 29 provided with a movable steel cutter 36. In this example, the cutter 29 is an electro-hydraulic cutter 29. However, other types of cutters can be used. The cutting device 30 may comprise a guide member 31 for guiding the wire towards the steel cutter 36. In the illustrated example, the guide member 31 is attached to the cutter 29. In an alternative embodiment, the guide member 31 can be a separated part movable with respect to the cutting device 30. The guide member 31 has an accommodation 32 with an inlet 34 arranged to receive the end of the wire 3*a* when the rotational member 6 is rotated in the second direction. In the illustrated example, the cutting device 30 is linearly movable between a retracted position and a forward position, as shown in FIGS. 12*a-b*. In this example, the cutting device 30 is movable in an axial direction of the rotational member 6. The steel cutter 36 is cutting the wire while in the forward position and is retracted after completed cutting process. In its retracted location it is positioned and ready for the next trimming operation. The rotational member 6 comprises an actuator 37 for moving the cutting device 30. The control unit 12 is controlling the actuator 37 and accordingly the motions of the cutting device 30. In an alternative embodiment, the cutting device 30 can be fixedly attached to the rotational member 6 and accordingly not movable with respect the rotational member, and the guide member 31 is movable with respect to the cutting device 30. This is advantageous if the cutting device is heavy.

The cutting device 30 is arranged to move the steel cutter 36 upon receiving the cutting command so that the wire guided by the accommodation 32 is cut. The cutting device 30 may comprises an actuator (not shown) for moving the steel cutter so that it cuts the wire. For example, the actuator is an electrical motor driving a small hydraulic pump. The hydraulic fluid in the pump is pressing against the steel cutter 36, forcing it forward to cut the wire. The actuator for moving the steel cutter 36 is controlled by the control unit 12, and the actuator is activated upon receiving the cutting command.

FIG. 12*a* shows the cutting device 30 moving to the forward position when the end of the wire has been detected. FIG. 12*b* shows the cutting device 30 returning to the retracted position after the wire has been cut.

When the end of the wire has been detected, the control unit 12 sends an order to the actuator 37 to move the cutting device 30 from its retracted position to its forward position, as shown in FIG. 12*a*, so that the inlet 34 of the guide member 31 is aligned with the exit 24*a* of the receiving guide 24. While moving in a synchronized manner, the rotational member 6 and the drive roller 20 now start to rotate in the second direction, moving the end of the wire 3*a* into the accommodation 32 of the guide member 31, through the accommodation 32, through the cutter 29 and further into a segmented discard wire guide (not shown).

During the rotation of the rotational member 6 in the second direction, the distance sensor 18 measures the actual length of wire passing through support unit 14. This movement continues until the distance travelled along the wire in the second direction is equal to the predetermined cutting distance. This means that a specific length of wire has been collected in the discard wire guide. At this point all rotating movements stop and the cutter 29 make a cut, separating the wire accumulated in the discard wire guide from the wire on the opposite side of the cutting device 30, which now is the new front-end of the last wire loop. After the wire has been cut, while moving in a synchronized manner, the rotational member 6 and the drive roller 20 now start to rotate in the opposite direction from the previous step until the new front-end of the remaining plurality of circular wire loops exits the receiving guide completely. The trimming apparatus can now move away from the plurality of circular wire loops to a retracted discard position by means of an electrical motor acting with a teethed pinion against a teethed rack.

The present invention is not limited to the embodiments disclosed but may be varied and modified within the scope of the following claims. For example, by arranging the trimming apparatus in a vertical orientation, the same activities can be performed on a wire rod coil placed on a vertical pallet.

REFERENCE LIST

1. Automatic trimming apparatus
2. coil
3. wire loops
3*a* end of the wire
4. base frame
6. rotational member
8. space
10 first actuator
12. control unit
14. support unit
16. sensor assembly
16*a* sensor roller
16*b* inductive sensor
17. defined area of the space
18. distance sensor
20 drive roller
21. Second actuator
22. pinch roller
23. actuator
24. receiving guide
24*a*. exit of the receiving guide
25 actuator
26. recess of wire receiving guide
28. groove of the wire receiving guide

29. cutter
30 cutting device
31. guide member
32. accommodation of guide device
34 inlet of the guide member
36. steel cutter
37 actuator for moving the cutting device
40 rail
42 separating roller
44 landing surface
46 vision sensor
48 gripping device
A1 centre axis of the rotational member

The invention claimed is:

1. An automatic trimming apparatus for wire coils including a plurality of wire loops, wherein the apparatus comprises:

a base frame, a rotational member rotatably connected to the base frame, and having a space for receiving a wire loop of the plurality of wire loops of the coil, a first actuator arranged to rotate the rotational member in two opposite directions, and a control unit arranged to control the first actuator, wherein the rotational member is provided with a support unit arranged in said space for supporting the wire loop when the rotational member is rotated, a sensor assembly arranged for sensing the presence of a wire in a defined area of the space, a distance sensor for sensing a distance travelled along the wire when the rotational member is rotated, and a cutting device, and the control unit is adapted to receive outputs from the sensor assembly and the distance sensor, detect an end of the wire based on the output from the sensor assembly, control the first actuator so that the rotational member is rotated in a first direction until the end of the wire is detected, control the first actuator so that the rotational member is rotated in a second direction opposite the first direction when the end of the wire has been detected, determine the distance travelled along the wire in the second direction based on the output from the distance sensor, and generate a cutting command based on the distance travelled along the wire from the end of the wire and a predetermined cutting distance, and the cutting device is arranged to cut the wire upon receiving the cutting command from the control unit.

2. The automatic trimming apparatus according to claim 1, wherein the support unit comprises a drive roller and a pinch roller arranged movable with respect to the drive roller in a radial direction of the rotational member to allow the wire loop to be clamped between the drive roller and the pinch roller.

3. The automatic trimming apparatus according to claim 2, wherein the drive roller and the pinch roller are rotatably arranged with respect to the rotational member, and the drive roller and the pinch roller are arranged so that they rotate in opposite directions with respect to each other when the wire is clamped between them and the rotational member is rotated in any of the first and the second directions so that the drive roller and the pinch roller are rolled along the wire while the rotational member is rotated.

4. The automatic trimming apparatus according to claim 2, wherein the apparatus comprises a second actuator arranged to rotate the drive roller in two opposite directions, and the control unit is adapted to control the first and second actuators so that the drive roller and the rotational member are rotated in the same direction in a synchronized manner.

5. The automatic trimming apparatus according to claim 2, wherein the rotational member is arranged rotatable with respect to the base frame about a first rotational axis, the drive roller is arranged rotatable with respect to a second rotational axis, and the pinch roller is arranged rotatable with respect to a third rotational axis, and the first, second, and third rotational axes are in parallel.

6. The automatic trimming apparatus according to claim 4, wherein the control unit is adapted to control the first and second actuators so that the rotational member and the drive roller rotate in the first direction in a synchronized manner until the end of the wire has been detected, and to control the first and second actuators so that the rotational member 6 and the drive roller rotate in the second direction after the end of the wire has been detected.

7. The automatic trimming apparatus according to claim 2, wherein the distance sensor is a pulse encoder arranged to detect the rotational motions of any of the drive roller or the pinch roller.

8. The automatic trimming apparatus according to, wherein the control unit is adapted to generate the cutting command when the distance travelled along the wire from the end of the wire corresponds to the predetermined cutting distance.

9. The automatic trimming apparatus according to claim 1, wherein the cutting device comprises an accommodation with an inlet arranged to receive the end of the wire when the rotational member is rotated in the second direction, the cutting device comprises a steel cutter, and the cutting device is arranged to move the steel cutter upon receiving the cutting command so that the wire is cut.

10. The automatic trimming apparatus according claim 1, wherein the rotational member is provided with a wire receiving guide for receiving the wire loop, and the wire receiving guide is arranged movable between an extended position outside the space and a retracted position inside the space.

11. The automatic trimming apparatus according to claim 10, wherein the wire receiving guide has a recess for receiving the pinch roller in the retracted position, the wire receiving guide is arranged linearly movable with respect to the pinch roller in an axial direction of the rotational member, and the pinch roller is arranged linearly movable with respect to the recess in the radial direction of the rotational member.

12. The automatic trimming apparatus according claim 1, wherein the distance sensor is arranged to detect the distance travelled by the support unit along the wire.

13. The automatic trimming apparatus according to claim 1, wherein the support unit comprises a drive roller and a pinch roller arranged movable with respect to the drive roller in a radial direction of the rotational member to allow the wire loop to be clamped between the drive roller and the pinch roller, and wherein a wire receiving guide has a recess for receiving the pinch roller in a retracted position, the wire receiving guide is arranged linearly movable with respect to the pinch roller in an axial direction of the rotational member, and the pinch roller is arranged linearly movable with respect to the recess in the radial direction of the rotational member.

* * * * *